US005971172A

United States Patent [19]

Cockerham

[11] Patent Number: 5,971,172

[45] Date of Patent: Oct. 26, 1999

[54] FOLDING ARTIFICIAL CHRISTMAS TREE FRAME

[76] Inventor: Harry M. Cockerham, 5716 Haweswater Rd., Winston-Salem, N.C. 27105

[21] Appl. No.: 09/028,759

[22] Filed: Feb. 24, 1998

[51] Int. Cl.[6] ..... A47F 5/14

[52] U.S. Cl. ..... 211/181.1; 211/195; D11/118

[58] Field of Search ..... 211/181.1, 168, 211/189, 195; 248/528, 529, 518; D11/118, 130, 131.1; 428/7–9; 493/956

[56] References Cited

U.S. PATENT DOCUMENTS

| | | | |
|---|---|---|---|
| D. 44,397 | 7/1913 | Berggren | D11/118 |
| D. 200,455 | 2/1965 | Freund et al. | D11/118 X |
| D. 368,673 | 4/1996 | Hermsdorfer et al. | D11/118 |
| D. 387,303 | 12/1997 | Hansen | D11/118 |
| D. 390,806 | 2/1998 | Skarda, Jr. | D11/118 |
| 1,241,486 | 10/1917 | Armstrong | 211/195 |
| 1,590,220 | 6/1926 | Wurts | 211/197 |
| 2,850,826 | 9/1958 | Testa | 47/39 |
| 2,864,192 | 12/1958 | Shoalts . | |
| 2,911,748 | 11/1959 | Rodgers | 211/20 |
| 2,988,837 | 6/1961 | Hutton | 428/12 |
| 3,027,671 | 4/1962 | Duvall . | |
| 3,031,785 | 5/1962 | Carlson | 428/8 |
| 3,692,617 | 9/1972 | Marks et al. | 211/205 |
| 3,857,748 | 12/1974 | Thomann . | |
| 4,109,036 | 8/1978 | Lloyd et al. . | |
| 4,285,163 | 8/1981 | Booker, Jr. | 211/195 X |
| 4,511,607 | 4/1985 | White . | |
| 4,612,218 | 9/1986 | Enterline . | |
| 5,128,180 | 7/1992 | Acton | 428/20 |
| 5,307,252 | 4/1994 | Croup et al. . | |
| 5,409,745 | 4/1995 | McGuire . | |
| 5,507,399 | 4/1996 | Hermanson | 211/181.1 |
| 5,758,948 | 6/1998 | Hale | 428/8 X |

*Primary Examiner*—Daniel P. Stodola
*Assistant Examiner*—Jennifer E. Novosad
*Attorney, Agent, or Firm*—Richard C. Litman

[57] ABSTRACT

A folding artificial Christmas frame adapted to be mounted onto a vertical structure, such as a wall, a door or the like. The frame includes a generally triangular top frame portion that is hingedly connected to a bottom frame portion having a generally truncated triangular shape. The top and bottom frame portions may be folded together to facilitate storage.

17 Claims, 3 Drawing Sheets

FOLDING ARTIFICIAL CHRISTMAS TREE FRAME

BACKGROUND OF THE INVENTION

1. Field of the Invention

The present invention relates to artificial Christmas trees and, in particular, to a new and improved folding frame for an artificial Christmas tree which may be mounted on a wall, door, or the like.

2. Description of the Related Art

It is frequently necessary during the Christmas season to rearrange furniture in order to provide space for a Christmas tree, whether it be real or artificial. This rearrangement sometimes requires that furniture be placed in undesirable locations to provide space for the tree. In order to solve this problem, a variety of Christmas trees have been created which are mounted on a wall, door, or the like.

However, many of these artificial trees are either to bulky to be easily stored, or breakdown into numerous parts which are inconvenient to handle and may easily be misplaced. Therefore, there is a need for a folding artificial Christmas tree frame which may mounted on a vertical structure, such as a wall, adorned with a wide variety of decorations, and folded for easy storage.

U.S. Pat. No. 5,409,745 discloses an Artificial Christmas Tree having a vertical trunk with a plurality of openings therein for receiving removable, flexible branches. The branches may be arranged in a configuration which allows the tree to be placed against, and attached to, a vertical surface, such as a wall. U.S. Pat. No. 5,307,252 discloses a Wall Supported Christmas tree comprising the front half of a Christmas tree attached to a rigid, planar support surface which may be attached to a wall or the like.

U.S. Pat. No. 4,612,218 discloses an Artificial Christmas Tree comprising a rigid, planar support surface with a plurality of mounting holes therein for receiving flexible branches. The Christmas tree may be mounted on a vertical surface, such as a wall or the like.

U.S. Pat. No. 4,511,607 discloses a Window Mounted Christmas Tree comprising a resiliently mounted upright support member which mounts between the top and bottom of a window frame. The support member has a plurality of openings therein for receiving flexible branches.

U.S. Pat. No. 4,109,036 discloses an Artificial Christmas Tree having an upright trunk with a plurality of holes therein for receiving flexible branches. The tree may be secured to a wall by a threaded fastener.

U.S. Pat. No. 3,857,748 discloses a Christmas Tree Assembly comprising a rigid, triangular backing plate which may be mounted on a vertical structure, such as a door. A vertical trunk having a plurality of holes therein for receiving flexible branches is attached to the backing plate.

U.S. Pat. No. 3,027,671 discloses a Wall Mounted Simulated Christmas Tree including an upright trunk for supporting a plurality of rigid branches.

U.S. Pat. No. 2,864,192 discloses a Simulated Christmas Tree that has a large rectangular backing plate having a series of arcuate wire members connected by radially extending wire members and upwardly extending wire members all in a configuration to simulate a Christmas tree.

None of the above inventions and patents, taken either singly or in combination, is seen to describe the instant invention as claimed.

SUMMARY OF THE INVENTION

In view of the foregoing limitations of artificial Christmas trees described in the prior art, the present invention provides a folding artificial Christmas tree frame which may be mounted on a vertical structure, such as a wall, adorned with a wide variety of decorations, and folded for easy storage.

The invention comprises a generally triangular top frame and a generally truncated triangular bottom frame that are fastened together to form the general shape of a Christmas tree. The frames are attached together by a pivoting attachment means which allows the frames to be folded together for easy storage. Both frames have a plurality of horizontal and vertical braces which function both to provide support for the frame's structure, as well as to provide places from which to hang Christmas decorations, such as garlands and ornaments.

Accordingly, it is a principal object of the invention to provide a folding artificial Christmas tree frame that allows the user to place the tree in an area where space is a premium and has to be conserved.

It is another object of the invention to provide a folding artificial Christmas tree frame that may be mounted on a vertical structure, such as a door, a wall, or the like, so as not to unnecessarily occupy usable floor space.

It is a further object of the invention to provide a folding artificial Christmas tree frame that may be folded to allow for easy storage.

Still another object of the invention is to provide a folding artificial Christmas tree frame having a frame which may be decorated with a wide variety of different decorations.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
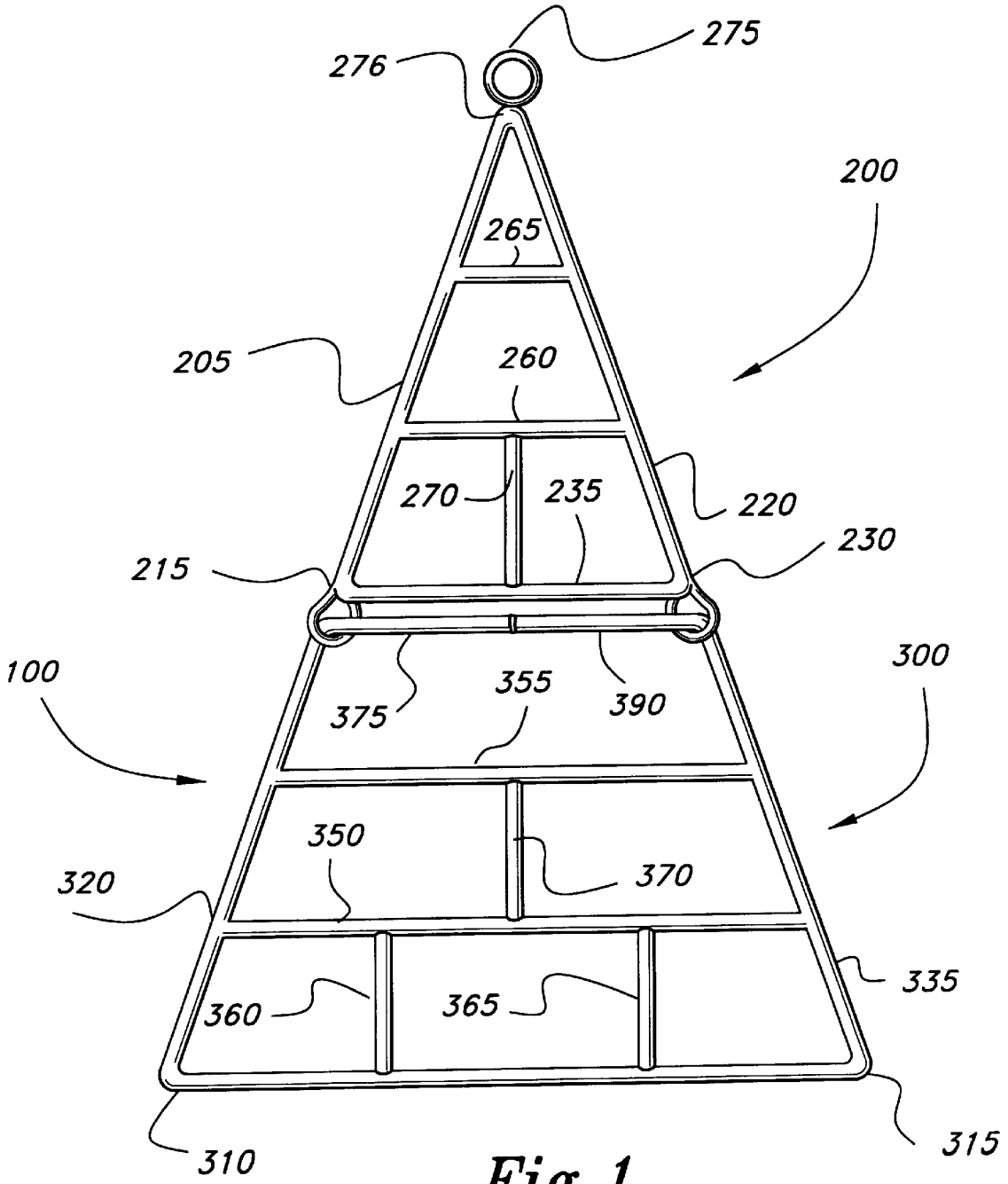
FIG. 1 is an environmental view of a folding artificial Christmas tree frame of the present invention.
Figure 4:
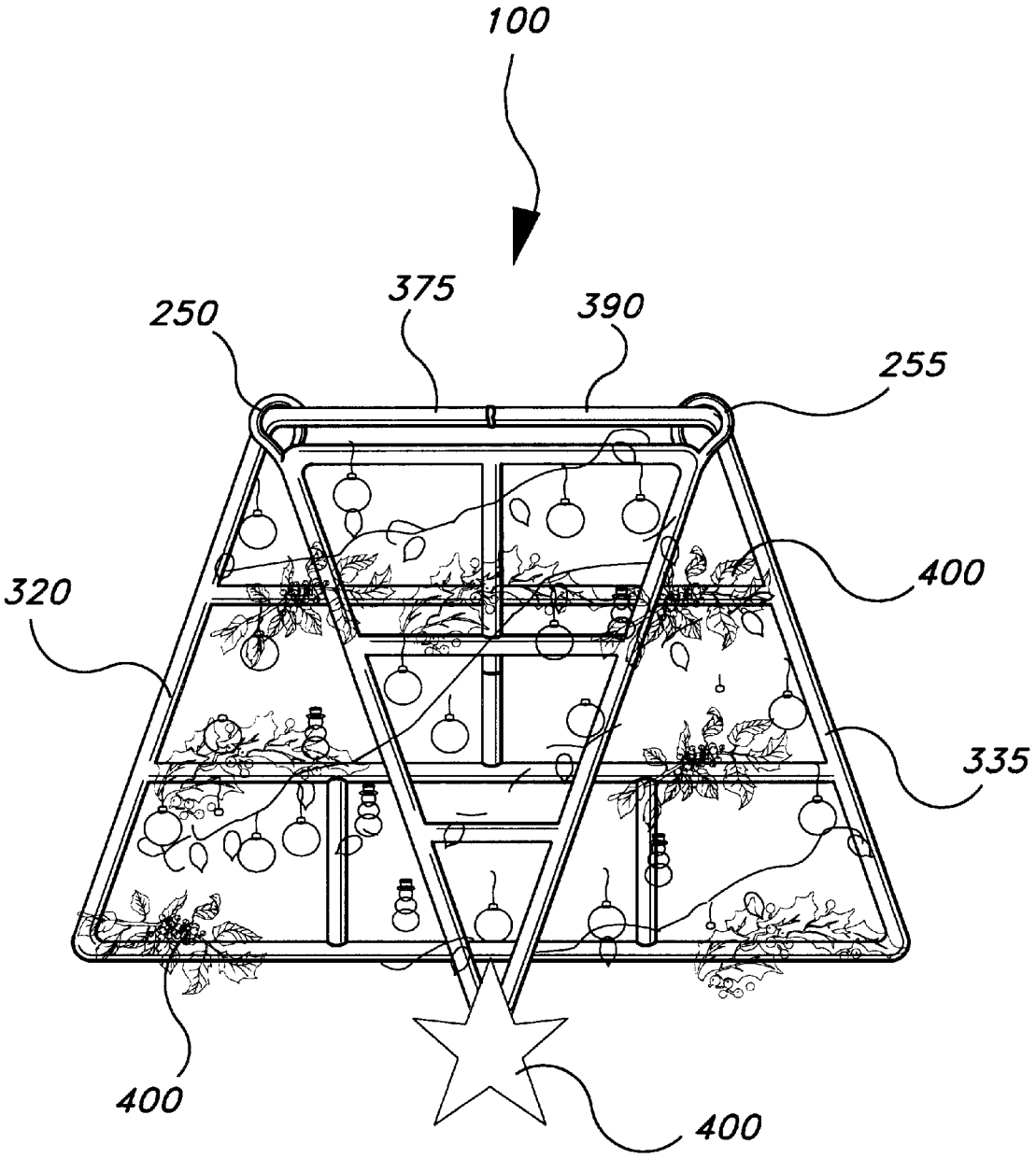
FIG. 4 is an environmental view of the decorated folding artificial Christmas tree frame showing the top frame portion and the bottom frame portion attached together and in a folded position.

Referring now to FIG. 1, a folding artificial Christmas tree frame 100 of the present invention is shown in an undecorated state. The Christmas tree frame 100 comprises a generally triangular top frame portion 200 and a generally truncated triangular bottom frame portion 300 which are pivotally interconnected together. The Christmas tree frame 100 is preferably made from substantially rigid plastic, although metal wire or any other suitable material may be used. The Christmas tree frame 100 can be mounted on any vertical structure, such as a door, a wall, or the like, and can be decorated with a wide variety of different decorations 400, as seen in FIG. 4. The frame 100 may be of any size to accommodate various mounting locations, such as inside a residence, or on the side of a building.

Figure 2:
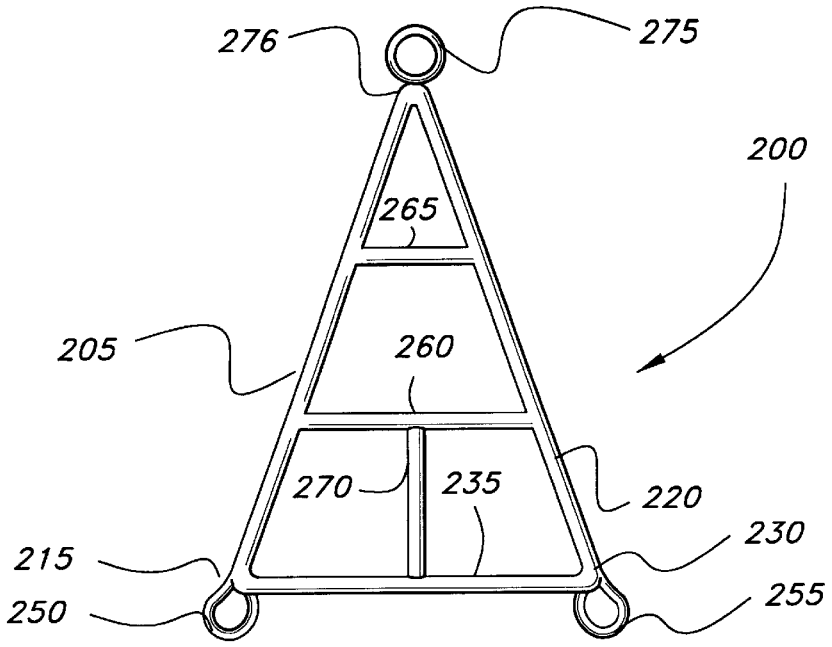
FIG. 2 is an environmental of the top frame portion of the present invention.

As seen in FIG. 2, the top frame portion 200 comprises a first top side arm 205 and a second top side arm 220, having equal lengths, and a top base arm 235, which are arranged into the configuration of an isosceles triangle having an apex 276, a first base angle 215 and a second base angle 230.

A first horizontally oriented top brace 260 and a second horizontally oriented top brace 265 are transversely mounted between the first top side arm 205 and the second top side arm 220, and parallel to the top base arm 235.

A vertically oriented top brace 270 is transversely mounted between the first horizontally oriented top brace 260 and the top base arm 235. The vertically oriented top brace 270 is positioned equidistant between the first top side arm 205 and the second top side arm 220 and perpendicular to the top base arm 235.

A hook 275 for mounting the folding Christmas tree frame 100 on a vertical structure is affixed to the apex 276 of the top frame portion 200. A first loop hinge 250 and a second loop hinge 255 are attached to the first base angle 215 and the second base angle 230, respectively. As best seen in FIG. 1, the first loop hinge 250 and the second loop hinge 255 serve to hingedly connect the top frame portion 200 and the bottom frame portion 300 together.

Figure 3:
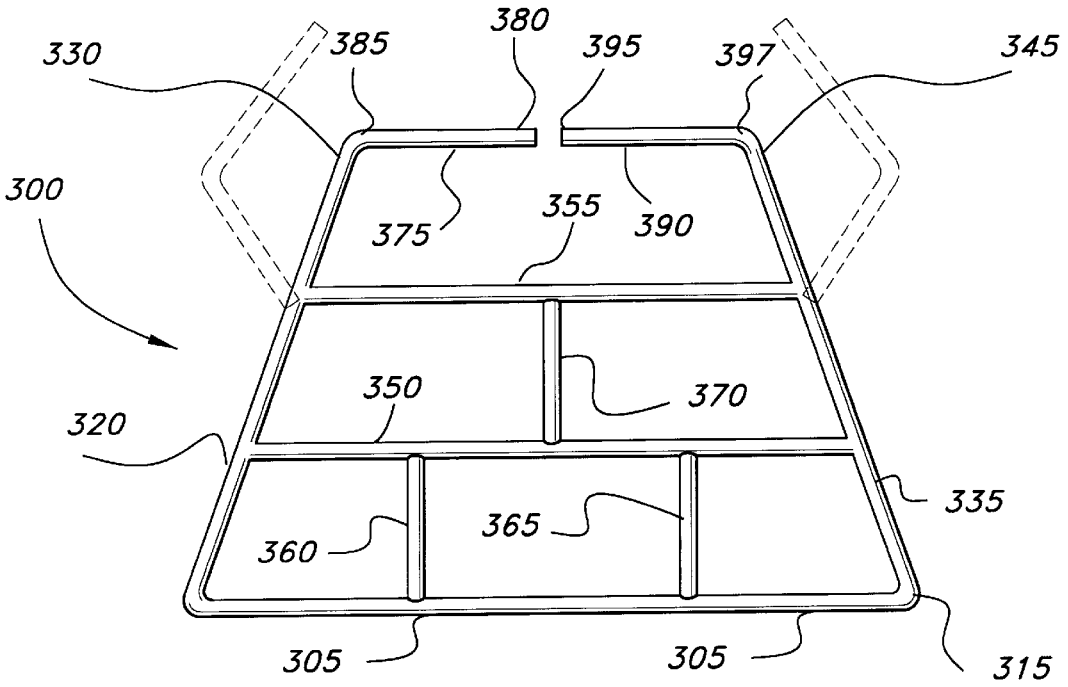
FIG. 3 is an environmental view of the bottom frame portion of the present invention showing the bottom side arms positioned to be attached to the top frame portion.

FIG. 3 illustrates a bottom frame portion 300 defined by a bottom base arm 305, and a first bottom side arm 320 and second bottom side arm 335, both being of equal length, which are arranged to form a generally truncated triangular shape.

A first horizontally oriented bottom brace 350 and a second horizontally oriented top brace 355 are mounted between the first bottom top side arm 320 and the second bottom side arm 335, and parallel to the bottom base arm 305.

A first vertically oriented bottom brace 360 and a second vertically oriented bottom brace 365 are transversely mounted between the first horizontally oriented bottom brace 350 and the second horizontally oriented bottom brace 355. Both the first vertically oriented top brace 360 and the second vertically oriented bottom brace 365 are perpendicular to the bottom base arm 305. A third vertically oriented bottom brace 370 is transversely mounted between the first horizontally oriented bottom brace 350 and the second horizontally oriented top brace 355. The third vertically oriented top brace 370 is positioned equidistant between the first bottom side arm 320 and the second bottom side arm 335 and perpendicular to the bottom base arm 305.

A first hinge arm 375 has a first attachment end 380 and a first loop end 385 which is attached to a first hinge end 330 of the first bottom side arm 320. A second hinge arm 390 has a first attachment end 395 and a first loop end 397 which is attached to a second hinge end 345 of the second bottom side arm 335. The first hinge arm 375 and the second hinge arm 390 are spread apart and inserted through the first hinge loop 250 and the second hinge loop 255, respectively. The first attachment end 380 and the second attachment end 395 are then joined together, preferably by welding. Both the first hinge arm 375 and the second hinge arm 390 are parallel to the bottom base arm 305. As best seen in FIG. 4, the top frame portion 200 and the bottom frame portion 300 may be folded together to facilitate storage and transport.

It is to be understood that the present invention is not limited to the embodiment described above, but encompasses any and all embodiments within the scope of the following claims.

I claim:

1. A folding artificial Christmas tree frame comprising;

a generally triangular top frame portion comprising:

a first top side arm and a second top side arm, having equal lengths, and a top base arm, arranged into the configuration of an isosceles triangle having an apex and a first base angle and a second base angle;

a first hinge loop and a second hinge loop attached to said first base angle and said second base angle respectively;

a plurality of horizontally oriented top braces transversely mounted between said first top side arm and said second top side arm;

at least one vertically oriented top brace; and a hook attached to said apex of said triangular top frame for hanging said frame;

a generally truncated triangular bottom frame portion comprising:

a first bottom side arm, and a second bottom side arm, having equal lengths, and each having a first loop end and a second loop end, respectively, and a bottom base arm, arranged into a generally truncated triangular configuration;

a plurality of horizontally oriented bottom braces transversely mounted between said first bottom side arm and said at least one vertically oriented bottom brace; and a first hinge arm having a first attachment end, and a first loop end attached to a first hinge end of said first bottom side arm, and a second hinge arm having a second attachment end, and a second loop end attached to a second hinge end of said second bottom side arm, and said first hinge arm and said second hinge arm are both parallel to said base arm;

wherein said first hinge arm and said second hinge arm are inserted through said first hinge loop and said second hinge loop, respectively, and said first attachment end and said second attachment end are joined together, whereby said top frame portion and said bottom frame portion are secured together in a foldable relationship.

2. The folding artificial Christmas tree frame according to claim 1, wherein said top frame portion and said bottom frame portion are made of metal wire.

3. The folding artificial Christmas tree frame according to claim 1, wherein said top frame portion and said bottom frame portion are made of metal tubing.

4. The folding artificial Christmas tree frame according to claim 1, wherein said top frame portion and said bottom frame portion are made of plastic.

5. The folding artificial Christmas tree frame according to claim 1, wherein at least one said vertically oriented top brace is mounted between two of said plurality of horizontally oriented top braces.

6. The folding artificial Christmas tree frame according to claim 1, wherein at least one said vertically oriented top brace is mounted between one of said plurality of horizontally oriented top braces and said top base arm.

7. The folding artificial Christmas tree frame according to claim 1, wherein at least one said vertically oriented bottom brace is mounted between two of said plurality of horizontally oriented bottom braces.

8. The folding artificial Christmas tree frame according to claim 1, wherein at least one said vertically oriented bottom brace is mounted between one of said plurality of horizontally oriented bottom braces and said bottom base arm.

9. The folding artificial Christmas tree frame according to claim 1, wherein Christmas decorations are suspended from said top frame portion and said bottom frame portion.

10. A folding artificial Christmas tree frame for mounting on a vertical structure, said folding artificial Christmas tree comprising:

a generally triangular top frame portion comprising:

a first top side arm and a second top side arm, having equal lengths, and a top base arm, arranged into the configuration of an isosceles triangle having an apex and a first base angle and a second base angle;

a first hinge loop and a second hinge loop attached to said first top base arm end and said second top base arm end, respectively;

a plurality of horizontally oriented top braces, each of said plurality of top braces transversely mounted between said first top side arm and said second top side arm and each of said plurality being parallel to said top base arm;

at least one vertically oriented top brace perpendicular to said plurality of horizontally oriented top braces and said top base arm; and a hook attached to said apex of said triangular top frame for hanging said frame;

a generally truncated triangular bottom frame portion comprising:

a first bottom side arm, and a second bottom side arm, having equal lengths, and each having a first loop end and a second loop end, respectively, and a bottom base arm, arranged into a generally truncated triangular configuration;

a plurality of horizontally oriented bottom braces, each of said plurality of bottom braces transversely mounted between said first bottom side arm and said second bottom side arm and evenly spaced along said lengths thereof, and each of said plurality of bottom braces being parallel to said bottom base arm;

at least one vertically oriented bottom brace perpendicular to said plurality of horizontally oriented bottom braces and said bottom base arm; and a first hinge arm having a first attachment end, and a first loop end attached to a first hinge end of said first bottom side arm, and a second hinge arm having a second attachment end, and a second loop end attached to a second hinge end of said second bottom side arm, and said first hinge arm and said second hinge arm both being parallel to said bottom base arm;

wherein said first hinge arm and said second hinge arm are inserted through said first hinge loop and said second hinge loop, respectively, and said first attachment end and said second attachment end are joined together, whereby said top frame portion and said bottom frame portion are secured together in a foldable relationship.

11. The folding artificial Christmas tree frame according to claim 10, wherein at least one of said vertically oriented top braces is mounted between two of said plurality of horizontally oriented top braces.

12. The folding artificial Christmas tree frame according to claim 11, wherein Christmas decorations are suspended from said top frame portion and said bottom frame portion.

13. The folding artificial Christmas tree frame according to claim 10, wherein at least one said vertically oriented top brace is mounted between one of said plurality of horizontally oriented top braces and said top base arm.

14. The folding artificial Christmas tree frame according to claim 10, wherein at least one said vertically oriented bottom brace is mounted between two of said plurality of horizontally oriented bottom braces.

15. The folding artificial Christmas tree frame according to claim 10, wherein at least one said vertically oriented bottom brace is mounted between one of said plurality of horizontally oriented bottom braces and said bottom base arm.

16. A folding artificial Christmas tree frame for mounting on a vertical structure, said folding artificial Christmas tree comprising:

a generally triangular top frame portion comprising:

a first top side arm and a second top side arm, having equal lengths, and a top base arm, arranged into the configuration of an isosceles triangle having an apex and a first base angle and a second base angle;

a first hinge loop and a second hinge loop attached to said first top base arm end and said second top base arm end, respectively;

a first horizontally oriented top brace and a second horizontally oriented top brace, each transversely mounted between said first top side arm and said second top side arm and said first horizontally oriented top brace and said second horizontally oriented top brace being parallel to said top base arm, and said first horizontally oriented top brace being adjacent to said top base arm;

a vertically oriented top brace transversely mounted between said top base arm and said first horizontally oriented top brace and positioned equidistant between an end of said first top base arm and an end of said second top base arm, said vertically oriented top brace being perpendicular to said top base arm; and a hook attached to said apex of said triangular top frame for hanging said frame;

a generally truncated triangular bottom frame portion comprising:

a first bottom side arm, and a second bottom side arm, having equal lengths, and each having a first loop end and a second loop end, respectively, and a bottom base arm, arranged into a generally truncated triangular configuration;

a first horizontally oriented bottom brace and a second horizontally oriented bottom brace, each transversely mounted between said first bottom side arm and said second bottom side arm and evenly spaced along said lengths thereof, said first horizontally oriented bottom brace and said second horizontally oriented bottom brace being parallel to said bottom base arm, and said first horizontally oriented bottom brace being adjacent to said bottom base arm;

a first vertically oriented bottom brace and a second vertically oriented bottom brace, each transversely mounted between said bottom base arm and said first horizontally oriented bottom brace, said first vertically oriented bottom brace and said second vertically oriented bottom brace being evenly spaced along said length of said bottom base arm and parallel to each other, and said first vertically oriented bottom brace and said second vertically oriented bottom brace being perpendicular to said bottom base arm;

a third vertically oriented bottom brace, parallel to said first vertically oriented bottom brace and said second vertically oriented bottom brace, mounted between said first horizontally oriented bottom brace and said second horizontally oriented bottom brace and positioned equidistant between said first bottom side arm and said second bottom side arm; and a first hinge arm having a first attachment end, and a first loop end attached to a first hinge end of said first bottom side arm, and a second hinge arm having a second attachment end, and a second loop end attached to a second hinge end of said second bottom side arm, and said first hinge arm and said second hinge arm both being parallel to said bottom base arm; and wherein said first hinge arm and said second hinge arm are inserted through said first hinge loop and said second hinge loop, respectively, and said first attachment end and said second attachment end are joined together, whereby said top frame portion and said bottom frame portion are secured together in a foldable relationship.

17. The folding artificial Christmas tree frame according to claim 16, wherein Christmas decorations are suspended from said top frame portion and said bottom frame portion.

* * * * *